United States Patent [19]

Burk

[11] Patent Number: 5,021,131

[45] Date of Patent: Jun. 4, 1991

[54] OPTICALLY PURE 1,4-DIOLS

[75] Inventor: Mark J. Burk, Hockessin, Del.

[73] Assignee: E. I. Du Pont de Nemours and Company, Wilmington, Del.

[21] Appl. No.: 524,736

[22] Filed: May 17, 1990

[51] Int. Cl.[5] ..... C25B 3/00; C25B 3/04

[52] U.S. Cl. ..... 204/59 R; 204/72

[58] Field of Search ..... 204/59 R, 72, 73 R

[56] References Cited

U.S. PATENT DOCUMENTS

| | | | |
|---|---|---|---|
| 3,652,430 | 3/1972 | Beck et al. | 204/72 |
| 3,783,112 | 1/1974 | Beck et al. | 204/59 R |
| 3,787,299 | 1/1974 | Beck et al. | 204/59 R |
| 4,871,430 | 10/1989 | Noding | 204/72 |

OTHER PUBLICATIONS

Rand et al., "The Electrochemical Oxidation of Epimeric β-Hydroxycycloalkylacetic Acid", J. Org. Chem. 33(7), pp. 2704–2708 (1968).

Haufe et al., Chem. Ing. Tech. 42(4), pp. 170–175 (1970).

S. Masumune et al., Journal of Organic Chemistry, 54, 1755 (1989).

J. K. Lieser, Synthetic Communications, 13, 765 (1983).

G. E. Svadkovskaya et al., Russian Chemical Reviews, English translation, 29, 161, 180 (1960).

D. Seebach et al., Helv. Chim. Acta., 68, 2342–2349 (1985).

*Primary Examiner*—John F. Niebling

*Assistant Examiner*—Steven P. Marquis

[57] ABSTRACT

This invention relates to a novel, high yield process for the preparation of optically active substituted 1,4-diols with a high degree of enantiomeric purity.

10 Claims, No Drawings

OPTICALLY PURE 1,4-DIOLS

FIELD OF THE INVENTION

The invention relates to a novel, high yield process for the preparation of optically active substituted 1,4-diols with a high degree of enantiomeric purity.

BACKGROUND OF THE INVENTION

The preparation of one enantiomer of optically active substituted 1,4-diols, though known in the literature, is carried out with tedious, time consuming methods. For example, S. Masamune et al., Journal of Organic Chemistry, 54, 1755 (1989), teaches the use of Baker's yeast for the reduction of 2,5-hexane dione to (S,S)-2,5-hexanediol in 50% yield based on a method originally disclosed by J. K. Lieser, Synthetic Communications, 13, 765 (1983). Lieser had reported a yield of 57%. Enzymatic reductions can generally be used to provide only one enantiomer of the desired product and can have limitations such as high substrate specificity, low product yields, long reaction times (144 hrs in the Lieser reference) or complex isolation procedures due to the usually highly dilute reaction mixtures (ca. 5 grams per liter in the Lieser reference).

The electrochemical coupling of carboxylic acids, i.e., $2\ RCOOH \rightarrow R\text{-}R + 2\ CO_2 + H_2$ is known as Kolbe coupling.

U.S. Pat. No. 3,787,299 issued Jan. 22, 1974 discloses the Kolbe coupling of carboxylic acids and substituted carboxylic acids. The disclosed substituents, which may be in the $\beta$ position, include ester, acylamino, acyloxy, nitrilo, halo, aryl, alkyl, aralkyl or heterocyclic. There is no disclosure nor suggestion of the applicability to carboxylic acids with unprotected hydroxyl groups. There is no disclosure nor suggestion of the utility of this process for preparing optically active compounds with a high degree of enantiomeric purity.

G. E. Svadkovskaya et al., Russian Chemical Reviews, English Translation, 29, 161, 180 (1960), especially p 166, states that aliphatic hydroxy acids are not very suitable for the Kolbe reaction as the hydroxyl group is readily oxidized. "Negative results were obtained on electrolysing $\beta$-hydroxy acids." "Formic acid, crotonaldehyde, and other oxidation products are obtained from beta-hydroxy butyric acid."

The Kolbe coupling of hydroxy substituted carboxylic acids is reported to be a low yield reaction by J. Haufe et al., Chem. Ing. Tech., 42, 170–5 (1970).

L. Rand et al., J. Org. Chem., 33, 2704 (1968) report the electrochemical coupling of 1-hydroxycyclohexylacetic acid in a maximum yield (9 experiments) of 40%. There is no suggestion of a route to higher yield processes. There is no suggestion of applicability of the reaction to optically active compounds nor of the fate of optical activity if it were applicable to optically active compounds.

Thus, D. Seebach et al., Helv. Chim. Acta, 68, 2342 (1985) protected the hydroxyl group of optically active beta hydroxy carboxylic acids by esterification or etherification prior to Kolbe coupling. These workers reported that racemization of the "protected" $\beta$-hydroxy carboxylic acids did not occur during Kolbe coupling. There is no suggestion nor prediction of the fate of optical activity in the Kolbe coupling of "unprotected" beta hydroxy carboxylic acids.

By the process of the present invention is provided a high yield route to optically active 1,4-diols with a high degree of enantiomeric purity via the Kolbe coupling of optically active, "unprotected" beta hydroxy carboxylic acids with a high degree of enantiomeric purity in which racemization of the asymmetric carbon does not occur.

SUMMARY OF THE INVENTION

This invention provides a process for the preparation of optically active 1,4-diols of high enantiomeric purity of the structure $$R^1R^2C(OH)CH_2CH_2C(OH)R^1R^2$$

wherein:

$R^1$ and $R^2$ are each independently radicals comprising hydrogen, lower alkyl containing up to about 6 carbon atoms, phenyl, substituted phenyl, aralkyl or ring-substituted aralkyl, or wherein $R^1$ and $R^2$ are joined together to form a 4-, 5-, or 6-membered ring, and which process is characterized by the fact that the diols are obtained with a high degree of enantiomeric purity when starting materials with a high degree of enantiomeric purity are employed, said process comprising the steps of a) dissolving or suspending a $\beta$-hydroxy carboxylic acid with a high degree of enantiomeric purity of the formula $R^1R^2C(OH)CH_2COOH$, wherein $R^1$ and $R^2$ are as defined above, in a lower alcohol solvent, together with a catalytic amount of a corresponding alkali metal alkoxide, b) passing through said solution or suspension at least an equivalent amount of electrical current, and c) isolating the product.

DETAILED DESCRIPTION OF THE INVENTION

This invention provides a process for the preparation of optically active 1,4-diols of high enantiomeric purity of the structure $$R^1R^2C(OH)CH_2CH_2C(OH)R^1R^2$$

wherein:

$R^1$ and $R^2$ are each independently radicals comprising hydrogen, lower alkyl containing up to about 6 carbon atoms, phenyl, substituted phenyl, aralkyl or ring-substituted aralkyl, or wherein $R^1$ and $R^2$ are joined together to form a 4-, 5-, or 6-membered ring, and which process is characterized by the fact that the diols are obtained with a high degree of enantiomeric purity when starting materials with a high degree of enantiomeric purity are employed, said process comprising the steps of a) dissolving or suspending a $\beta$-hydroxy carboxylic acid with a high degree of enantiomeric purity of the formula $R^1R^2C(OH)CH_2COOH$, wherein $R^1$ and $R^2$ have the same meaning as that given above, in a lower alcohol solvent, together with a catalytic amount of a corresponding alkali metal alkoxide, b) passing through said solution or suspension at least an equivalent amount of electrical current, and c) isolating the product.

The process of the present invention provides a means of obtaining optically active product with a high degree of enantiomeric purity in high yields. Typically a minimum yield of 50% is achievable, and often the yield exceeds 60%.

For the purpose of this application, by a compound "with a high degree of enantiomeric purity", or a compound "of high enantiomeric purity" is meant a compound that exhibits optical activity to the extent of greater than or equal to about 90%, preferably, greater than or equal to about 95% enantiomeric excess (abbreviated ee).

Enantiomeric excess is defined as the ratio (%R−%S)/(%R+%S), where %R is the percentage of R enantiomer and %S is the percentage of S enantiomer in a sample of optically active compound.

The starting material β-hydroxy carboxylic acids, $R^1R^2C(OH)CH_2COOH$, of high enantiomeric purity can be readily prepared by hydrolysis of the corresponding β-hydroxy carboxylic acid esters (II) of high enantiomeric purity, which, in turn can be prepared when one of $R^1$ and $R^2$ are hydrogen by the stereoselective hydrogenation of β-keto esters (I).

This synthetic route is illustrated by the following equation:

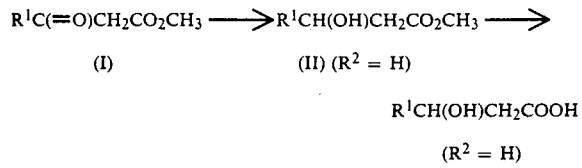

The first step in this sequence, the asymmetric reduction of β-keto esters to the optically active beta hydroxy esters, has been described by Noyori et al., J. Am. Chem. Soc., 109, 5856 (1987) and Kitamura et al., J. Am. Chem. Soc., 110, 629 (1988), each herein incorporated by reference. Conversion of the optically active beta hydroxy ester to the optically active beta hydroxy carboxylic acid is accomplished by alkaline hydrolysis followed by acidification and isolation.

The process of the present invention resides in the coupling of the optically active β-hydroxy carboxylic acid to the symmetrically substituted diols while maintaining the enantiomeric purity of the optically active β-hydroxy carboxylic acid. Prior to the discovery of the process of the present invention, some of the compounds

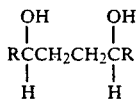

were available in a high degree of enantiomeric purity only with great difficulty; and others of the exemplified compounds were unknown in a high degree of enantiomeric purity.

The electrochemical coupling of the present invention is preferably carried out in lower alcohol solvent, where lower alcohol encompasses $C_1$ to $C_4$ alcohols, in the presence of the corresponding alkali metal alkoxide as base. Most preferred is the use of methanol and sodium methoxide.

The coupling reaction is normally carried out at normal atmospheric pressure, preferably under an atmosphere of an inert gas such as nitrogen. Reaction times can vary from 1 to 12 or more hours, and in some larger scale preparations, up to 72 hours. Agitation of the reaction mixture is a requirement.

The reaction temperature is typically in the range of from about −20° C. to about 60° C. A preferred temperature range is from about 0° C. to about 25° C. Most preferred is from about 0° C. to about 10° C.

The electrochemical coupling reaction is most preferably carried out using platinum electrodes to gain the high yields available from the present process.

Isolation of the product can be carried out by conventional means well known in the art such as distillation, crystallization, evaporation of solvent, filtration, chromatography, and the like. For example, concentration of the reaction mixture in vacuo followed by column chromatography of the residue is one means of product isolation.

The 1,4-diol compounds with a high degree of enantiomeric purity made by the process of the present invention are useful as intermediates in the preparation of optically active, asymmetry-inducing hydrogenation catalysts.

The following examples illustrate the process of the present invention, but are not intended to limit it in any manner.

EXAMPLES

The precursor chiral β-hydroxy esters used in the following examples of diol synthesis were prepared as described by Noyori et al., J. Amer. Chem. Soc., 109, 5856 (1987) which is herein incorporated by reference. The asymmetric reduction of β-keto esters to the β-hydroxy esters was conducted using a ruthenium catalyst bearing the chiral phosphine ligand BINAP (R)-(+) or (S)-(−)-2,2'-bis(diphenylphosphino)-1,1'-binaphthyl, (both enantiomers commercially available from Strem Chemicals, 7 Mulliken Way, Dexter Industrial Park, P.O. Box 108, Newburyport, Mass. 01950).

EXAMPLE 1

A. Preparation of chiral β-hydroxy acids

The hydrolysis of chiral β-hydroxy esters to the corresponding acids was conducted according to Noyori et al., J. Amer. Chem. Soc., 109, 5856 (1987), which is herein incorporated by reference, and Seebach, Helv. Chim. Acta, 68, 2342 (1985), also herein incorporated by reference. A general procedure for isolation of large quantities of the acids of interest was as follows.

A mixture of methyl (3R)-3-hydroxypentanoate (290 g, 2.2 mol) in water (200 mL) and ethanol (200 mL) was cooled to 0° C. To this cold solution was added a solution of KOH (185 g, 3.3 mol) in water (1 L). The reaction was then allowed to stir at 25° C. for 48 hours. The resulting solution was concentrated to ca. 500 mL and acidified (conc. HCl) until pH=1 was reached. The precipitated salts were filtered and the filtrate was subjected to continuous liquid/liquid extraction with diethyl ether (1 L) for 24 hours. The diethyl ether was removed on a rotovap to afford the product β-hydroxy acid as a colorless oil (250 g, 97%). The crude product was sufficiently pure to use in the Kolbe-coupling.

B. Preparation of (2R,5R)-2,5-hexanediol

A 100 mL reaction vessel was charged with (3R)-3-hydroxybutyric acid (1.0 g, 9.6 mmol), methanol (30 mL) and sodium methoxide (1.0 mL of a 0.5N solution in methanol, 0.05 mmol), and was then cooled to 0° C. Using a Pt foil anode (5 $cm^2$), a Pt screen cathode (5 $cm^2$), and a 50 V/40 amp power supply, a constant current (current density 0.25 $A/cm^2$) was applied until 1388 coulombs (1.5 F/mol) were passed. The reaction and gas evolution ($H_2$ and $CO_2$) proceeded normally until ca 1.0 F/mol current were passed, after which the resistance was observed to increase. The colorless solution was concentrated on a rotovap. Chromatography on $SiO_2$ (70% ethyl acetate/hexane) afforded the product as a colorless crystalline solid (0.36 g, 64%); m.p. 53°-54° C.

$[\alpha]^{25}D = -37.6°$ (c 1, $CHCl_3$).

$^1H$ NMR ($CD_2Cl_2$) δ 1.15 (d, $J_{HH}$=6.2 Hz, 6 H, $CH_3$), 1.50 (m, 4 H, $CH_2$), 2.95 (br, 2 H, OH), 3.75 (m, 2 H, CH).

$^{13}C$ NMR ($CD_2Cl_2$) δ 23.6, 35.9, 68.1.

EXAMPLE 2

Preparation of (3R,6R)-3,6-octanediol

A 100 mL reaction vessel was charged with (3R)-3-hydroxypentanoic acid (1.0 g, 8.5 mmol) prepared as in Example 1A, methanol (30 mL) and sodium methoxide (1.0 mL of a 0.5N solution in methanol, 0.05 mmol), and then was cooled to 0° C. Using a Pt foil anode (5 $cm^2$), a Pt screen cathode (5 $cm^2$), and a 50 V/40 amp power supply, a constant current (current density 0.25 $A/cm^2$) was applied until 1229 coulombs (1.5 F/mol) were passed. The reaction and gas evolution ($H_2$ and $CO_2$) proceeded normally until ca. 1.0 F/mol current were passed, after which the resistance was observed to increase. The colorless solution was concentrated on a rotovap. Chromatography on $SiO_2$ (60% ethyl acetate/hexane) afforded the product as a colorless crystalline solid (0.35 g, 56%); m.p. 51°-52° C.

$[\alpha]^{25}D = -21.8°$ (c 1, $CHCl_3$)

$^1H$ NMR δ 0.9 (t, $J_{HH}$=7.4 Hz, 6 H, $CH_3$), 1.45 (m, 6 H, $CH_2$), 1.60 (m, 2 H, $CH_2$), 2.55 (br, 2 H, OH), 3.46 (m, 2 H, CH).

$^{13}C$ NMR ($CD_2Cl_2$) δ 10.2, 31.0, 34.1, 74.0.

EXAMPLE 3

Preparation of (3S,6S)-3,6-dihydroxy-2,7-dimethyloctanediol

A 100 mL reaction vessel was charged with (3S)-3-hydroxy-4-methylpentanoic acid (1.0 g, 7.6 mmol) prepared as in Example 1A, methanol (30 mL) and sodium methoxide (1.0 mL of a 0.5N solution in methanol, 0.05 mmol), and then was cooled to 0° C. Using a Pt foil anode (5 $cm^2$), a Pt screen cathode (5 $cm^2$), and a 50 V/40 amp power supply, a constant current (current density 0.25 $A/cm^2$) was applied until 1097 coulombs (1.5 F/mol) were passed. The reaction and gas evolution ($H_2$ and $CO_2$) proceeded normally until ca. 1.0 F/mol current were passed, after which the resistance was observed to increase. The colorless solution was concentrated on a rotovap. Chromatography on $SiO_2$ (60% ethyl acetate/hexane) afforded the product as a colorless crystalline solid (0.36 g, 54%); m.p. 99°-101° C.

$[\alpha]^{25}D = +35.2°$ (c 1, $CHCl_3$)

$^1H$ NMR ($CDCl_3$) δ 0.89 (d, $J_{HH}$=6.8 Hz, 12 H, $CH_3$), 1.45 (m, 2 H, $CH_2$), 1.62 (m, 4 H, $CH_2$), 3.0 (br, 2 H, OH), 3.35 (m, 2 H, CH).

$^{13}C$ NMR ($CDCl_3$) δ 17.4, 18.7, 31.1, 34.0, 77.2.

What is claimed is:

1. A process for the preparation of optically active 1,4-diols of enantiomeric purity of greater than or equal to about 90% of the structure $$R^1R^2C(OH)CH_2CH_2C(OH)R^1R^2$$

wherein:

$R^1$ and $R^2$ are each independently hydrogen, lower alkyl, phenyl, substituted phenyl, aralkyl, or ring-substituted aralkyl; or $R^1$ and $R^2$ together are a 4-, 5-, or 6-membered ring, said process comprising the steps of a) dissolving or suspending β-hydroxy carboxylic acid with a high degree of enantiomeric purity of the formula $R^1R^2C(OH)CH_2COOH$, wherein $R^1$ and $R^2$ are as defined above, in a lower alcohol solvent, together with a catalytic amount of a corresponding alkali metal alkoxide, b) passing through said solution or suspension at least an equivalent amount of electrical current, and c) isolating the product.

2. The process of claim 1 wherein $R^1$ and $R^2$ are each independently $C_1$ to $C_6$ alkyl.

3. The process of claim 1 wherein one of $R^1$ or $R^2$ is H.

4. The process of claim 1 wherein the solvent is a $C_1$ to $C_4$ alcohol.

5. The process of claim 4 wherein the alcohol is methanol.

6. The process of claim 5 wherein the alkali metal alkoxide is sodium methoxide.

7. The process of claim 1 conducted at a temperature of from about −20° C. to about 60° C.

8. The process of claim 1 wherein the electrical current is passed between platinum electrodes.

9. The process of claim 1 conducted in an inert atmosphere.

10. The process of claim 1 wherein the minimum yield of optically active, 1,4-diol of high enantiomeric purity is 50%.

* * * * *